US006824253B2

(12) United States Patent
Hoisington et al.

(10) Patent No.: US 6,824,253 B2
(45) Date of Patent: Nov. 30, 2004

(54) LOW VOLTAGE INK JET PRINTING MODULE

(75) Inventors: Paul A. Hoisington, Norwich, VT (US); Yong Zhou, Hanover, NH (US)

(73) Assignee: Spectra, Inc., Lebanon, NH (US)

( * ) Notice: Subject to any disclaimer, the term of this patent is extended or adjusted under 35 U.S.C. 154(b) by 51 days.

(21) Appl. No.: 10/020,217

(22) Filed: Dec. 18, 2001

(65) Prior Publication Data

US 2003/0112319 A1 Jun. 19, 2003

(51) Int. Cl.[7] ..... B41J 2/045
(52) U.S. Cl. ..... 347/68
(58) Field of Search ..... 347/68, 54, 70, 347/49, 71, 72, 69; 29/25.35; 310/311, 342, 313 A, 312, 327, 365; 400/124, 16, 124.23; 427/100

(56) References Cited

U.S. PATENT DOCUMENTS 3,962,063 A 6/1976 Hingorany ..... 204/206
4,700,203 A * 10/1987 Yamamuro et al. ..... 347/68
5,340,510 A 8/1994 Bowen ..... 264/434
5,598,050 A 1/1997 Bowen et al. ..... 310/322
5,684,519 A * 11/1997 Matoba et al. ..... 347/54
5,691,960 A 11/1997 Gentilman et al. ..... 367/155
5,841,736 A 11/1998 Bowen et al. ..... 367/140
5,856,837 A * 1/1999 Kitahara et al. ..... 347/70
5,950,291 A 9/1999 Gentilman et al. ..... 29/25.35
6,107,726 A 8/2000 Near et al. ..... 310/328
6,111,818 A 8/2000 Bowen et al. ..... 367/140
6,217,150 B1 4/2001 Heydinger ..... 347/43
6,217,158 B1 4/2001 Kanaya et al. ..... 347/70
6,361,154 B1 * 3/2002 Watanabe et al. ..... 347/70

* cited by examiner

*Primary Examiner*—K. Feggins
(74) *Attorney, Agent, or Firm*—Fish & Richardson P.C.

(57) ABSTRACT

A method of manufacturing an ink jet printing module can include forming a piezoelectric element having a stiffened surface.

17 Claims, 8 Drawing Sheets

LOW VOLTAGE INK JET PRINTING MODULE

TECHNICAL FIELD

This invention relates to a method of manufacturing a low voltage ink jet printing module.

BACKGROUND

An ink jet printing module ejects ink from an orifice in the direction of a substrate. The ink can be ejected as a series of droplets generated by a piezoelectric ink jet printing module. An example of a particular printing module can have 256 jets in four groups of 64 jets each. A piezoelectric ink jet printing module can include a module body, a piezoelectric element, and electrical contacts that drive the piezoelectric element. Typically, the module body is a rectangular member into the surfaces of which are machined a series of ink chambers that serve as pumping chambers for the ink. The piezoelectric element can be disposed over the surface of the body to cover the pumping chambers in a manner to pressurize the ink in the pumping chambers to eject the ink.

SUMMARY

In general, an ink jet printing module includes a stiffened piezoelectric element. The stiffened piezoelectric element improves jetting of ink when a low voltage is applied to the element compared to non-stiffened piezoelectric element. This can also allow ink jet modules to be smaller because the piezoelectric element has been strengthened. The stiffened piezoelectric element has a rigidity in at least one dimension that is higher than a flat piezoelectric element. The stiffened piezoelectric element can have a curved surface to strengthen the element. The module can jet ink when driven with a voltage of less than 60 volts.

In one aspect, a method of manufacturing an ink jet printing module includes injection molding a precursor into a mold to form a stiffened piezoelectric element, and positioning the piezoelectric element over an ink chamber to subject ink within the chamber to a jetting pressure upon applying a jetting voltage.

In another aspect, a method of depositing ink includes delivering ink to an ink chamber, and applying a jetting voltage across a first electrode and a second electrode on a face of a stiffened piezoelectric element to subject ink within the chamber to a jetting pressure, thereby depositing ink from an exit orifice of the ink chamber.

In another aspect, an ink jet printing module includes an ink chamber, a stiffened piezoelectric element having a region exposed to the ink chamber, and electrical contacts arranged on a surface of the piezoelectric element for activation of the piezoelectric element when a jetting voltage is applied to the electrical contacts. The piezoelectric element is positioned over the ink chamber to subject ink within the chamber to jetting pressure. The region of the stiffened piezoelectric element exposed to the ink chamber can have a curved surface.

The stiffened piezoelectric element can have a curved surface over the ink chamber. The curved surface can be concave relative to the ink chamber. The curved surface can have a substantially constant radius of curvature. The curved surface can be a spherical section or a cylindrical section. A wall of the chamber can be oriented to contact the stiffened piezoelectric element at an angle of greater than ninety degrees. The piezoelectric element can include lead zirconium titanate.

The ink jet printing module can include a series of chambers. Each of the chambers can be covered by a single piezoelectric element. A first electrode and a second electrode can be placed on a surface of the piezoelectric element.

Details are set forth in the accompanying drawings and the description below. Other features and advantages will be apparent from the description and drawings, and from the claims.

DETAILED DESCRIPTION

An ink jet printing module includes a piezoelectric element positioned over jetting regions of a body. The jetting regions can be portions of pumping chambers within the body. The pumping chambers can be sealed. Electrical contacts, such as electrodes, can be positioned on a surface of the piezoelectric element. The piezoelectric element spans each jetting region. When a voltage is applied to an electrical contact, the shape of the piezoelectric element changes in a jetting region, thereby subjecting the ink within the corresponding pumping chamber to jetting pressure. The ink is ejected from the pumping chamber and deposited on a substrate.

Figure 1B:
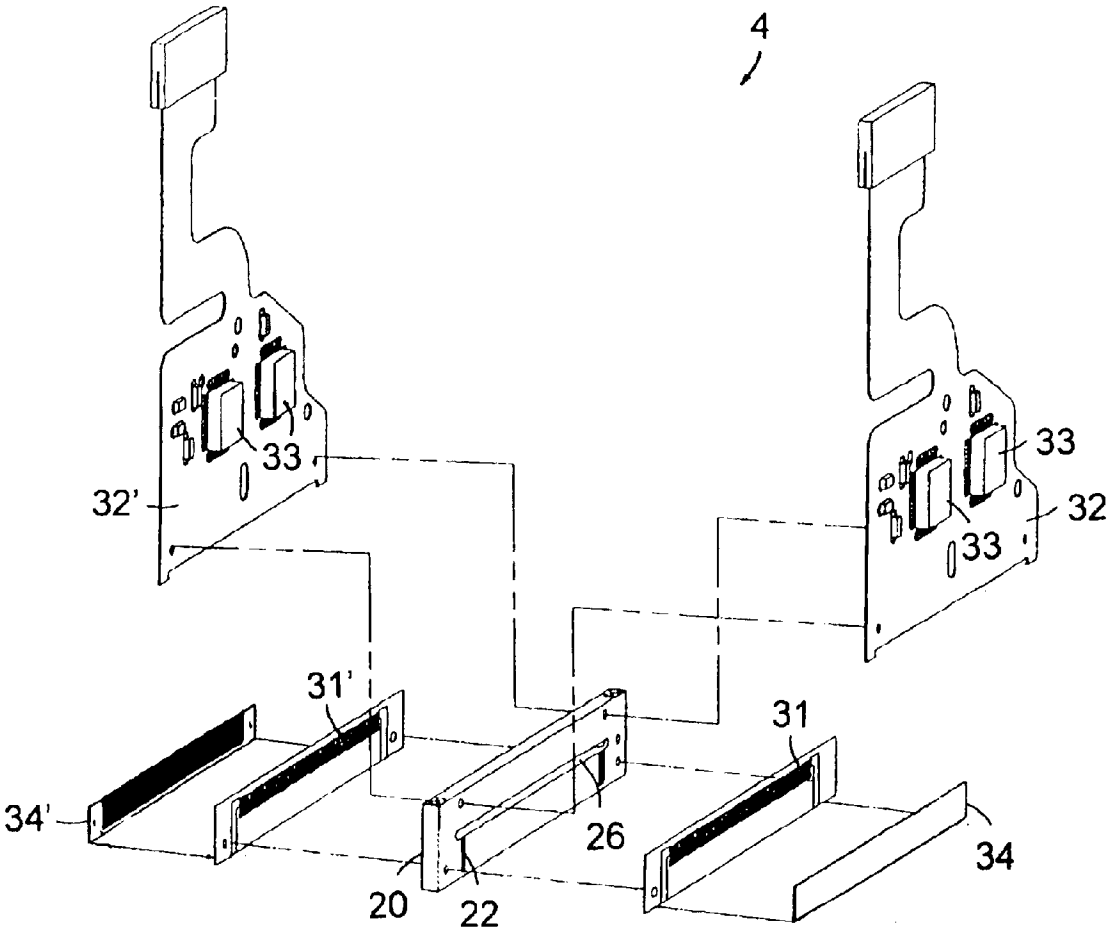
FIGS. 1A and 1B are schematic diagrams depicting an ink jet printing module.
Figure 1A:
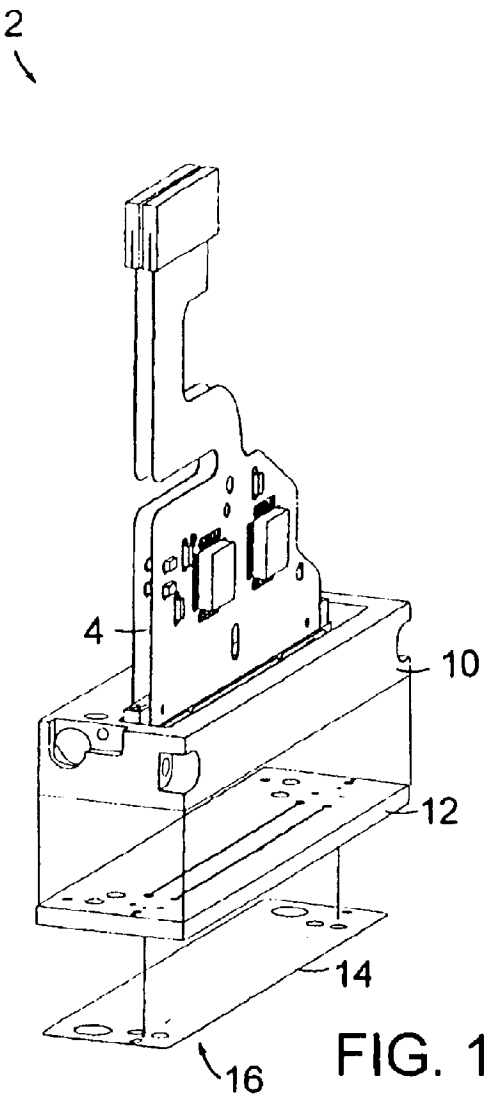
Figure 2:
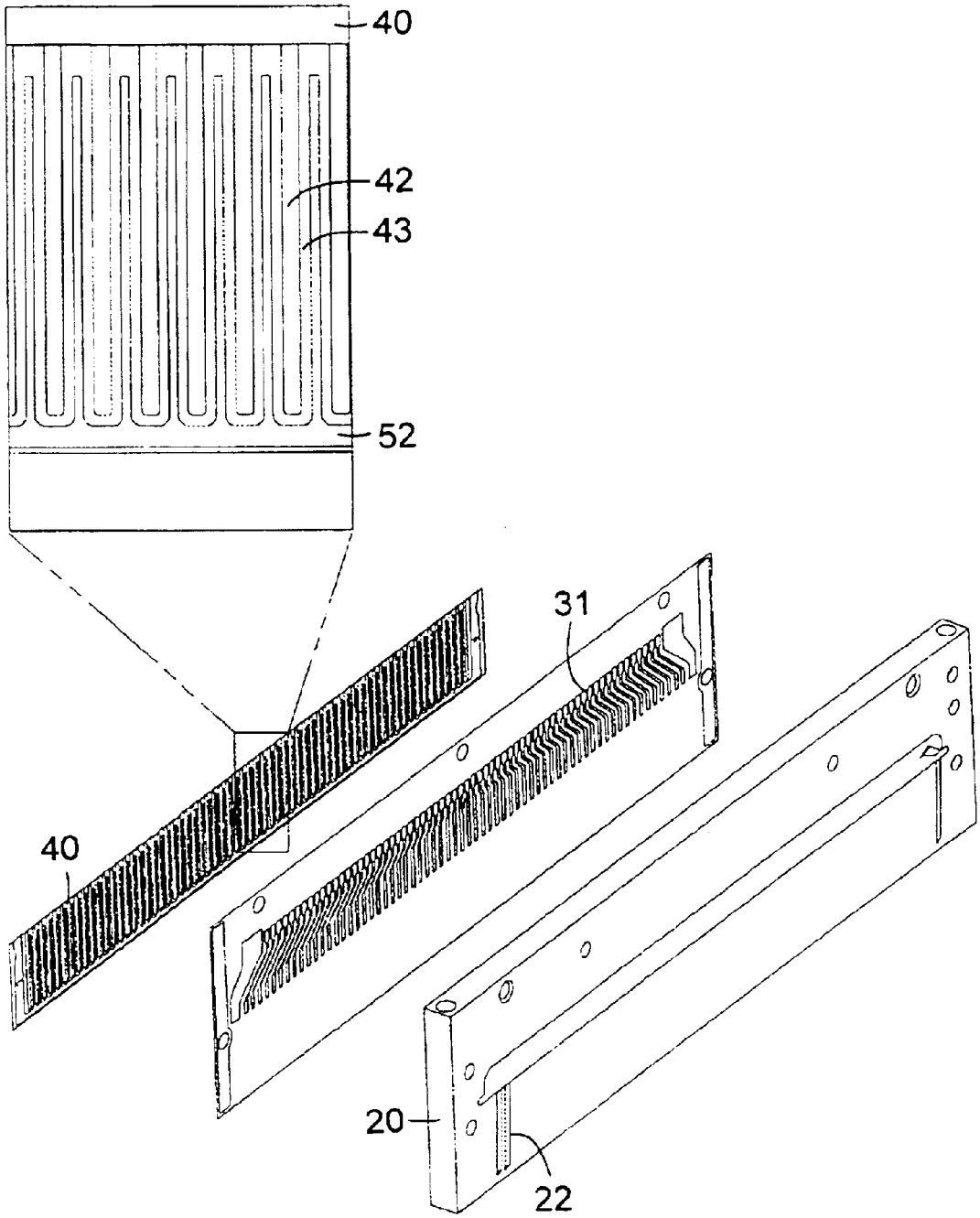
FIG. 2 is a schematic diagram depicting a portion of an ink jet printing module.

One example of a piezoelectric ink jet printing module is a shear mode module, such as the module described in U.S. Pat. No. 5,640,184, the entire contents of which is incorporated herein by reference. The electrical contacts in a shear mode module can be located on the side of the piezoelectric element adjacent to the ink chamber. Referring to FIGS. 1A, 1B and 2, piezoelectric ink jet head 2 includes one or more modules 4 which are assembled into collar element 10 to which is attached manifold plate 12 and orifice plate 14. Ink is introduced into module 4 through collar 10. Module 4 is actuated to eject ink from orifices 16 on orifice plate 14. Ink jet printing module 4 includes body 20, which can be made from materials such as sintered carbon or a ceramic. A plurality of chambers 22 are machined or otherwise manufactured into body 20 to form pumping chambers.

Ink passes through ink fill passage 26, which is also machined into body 20, to fill the pumping chambers. Opposing surfaces of body 4 include a series of electrical contacts 31 and 31' arranged to be positioned over the pumping chambers in body 20. Electrical contacts 31 and 31' are connected to leads, which, in turn, can be connected to integrated circuits 33 and 33'. The components are sealed together to form the print module.

Referring to FIG. 2, piezoelectric element 34 has electrodes 40 on one surface of the piezoelectric element 34. Electrodes 40 register with electrical contacts 31, allowing the electrodes to be individually addressed by a driver integrated circuit. Electrodes 40 can be formed by chemically etching away conductive metal that has been deposited onto the surface of the piezoelectric element. Suitable methods of forming electrodes are also described in U.S. Pat. No. 6,037,707, which is herein incorporated by reference in its entirety. The electrode can be formed of conductors such as copper, aluminum, titanium-tungsten, nickel-chrome, or gold. Each electrode 40 is placed and sized to correspond to a chamber 22 in body 4 to form a pumping chamber. Each electrode 40 has elongated region 42, having a length and width slightly narrower than the dimensions of the pumping chamber such that gap 43 exists between the perimeter of electrodes 40 and the sides and end of the pumping chamber. These electrode regions 42, which are centered on the pumping chambers, are the drive electrodes that cover a jetting region of piezoelectric element 34. A second electrode 52 on piezoelectric element 34 generally corresponds to the area of body 20 outside chamber 22, and, accordingly, outside the pumping chamber. Electrode 52 is the common (ground) electrode. Electrode 52 can be comb-shaped (as shown) or can be individually addressable electrode strips. The film electrodes and piezoelectric element electrodes overlap sufficiently for good electrical contact and easy alignment of the film and the piezoelectric element.

The piezoelectric element can be a single monolithic lead zirconium titanate (PZT) member. The piezoelectric element drives the ink from the pumping chambers by displacement induced by an applied voltage. The displacement is a function of, in part, the poling of the material. The piezoelectric element is poled by the application of an electric field. A poling process is described, for example, in U.S. Pat. No. 5,605,659, which is herein incorporated by reference in its entirety. The degree of poling can depend on the strength and duration of the applied electric field. When the poling voltage is removed, the piezoelectric domains are aligned. The piezoelectric element can have a thickness of 5 to 300 microns, 10 to 250 microns, 15 to 150 microns, less than 100 microns, or less than 50 microns.

Subsequent applications of an electric field, for example, during jetting, can cause a shape change proportional to the applied electric field strength.

Figure 3:
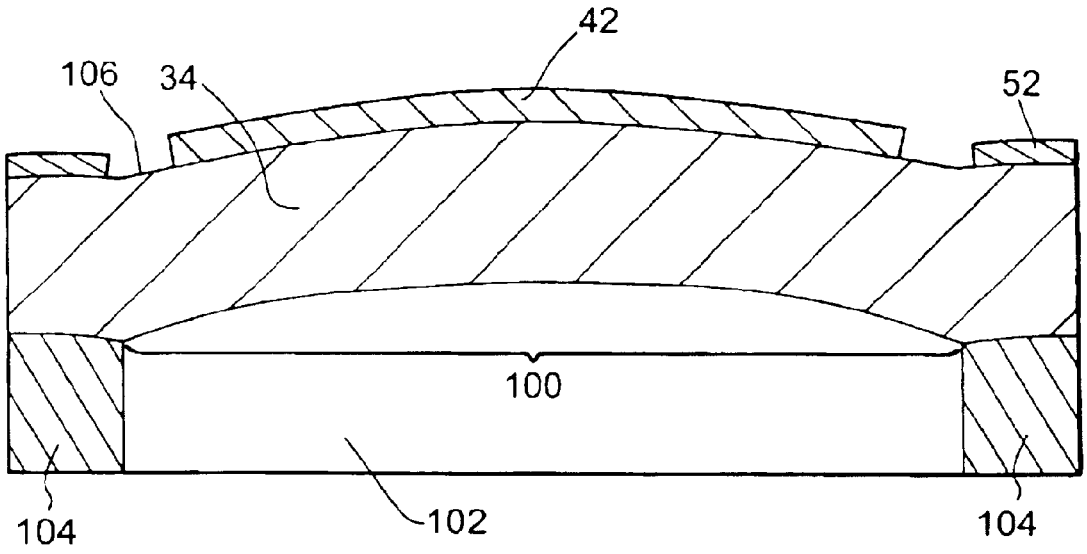
FIG. 3 is a schematic diagram depicting a piezoelectric element.

The piezoelectric element can be stiffened, for example, by introducing a curved surface in a portion of the element that covers the ink chamber. The curved surface can have a substantially constant curvature, such as a spherical or cylindrical shape. Referring to FIG. 3, a region 100 of piezoelectric element 34 is curved. The curvature of the piezoelectric element 34 is concave relative to ink chamber 102. The concave curvature of the surface can reduce buckling that otherwise may occur during jetting. Walls 104 of the chamber 102 can be oriented to contact the stiffened piezoelectric element 34 at an angle of greater than ninety degrees. The chamber can have a width of less than 1200 microns, a width of 50 to 1000 microns, or a width of 100 to 800 microns. Electrodes 42 and 52 are on surface 106 of the piezoelectric element 34. By applying a jetting voltage across the electrodes, ink within the chamber is subjected to a jetting pressure, which deposits ink from an exit orifice of the ink chamber. For example, the jetting voltage can be less than 60 volts.

The curved surface can have a substantially constant radius of curvature. The degree of curvature, or radius of curvature, affects the stiffness and jetting characteristics of the module. The radius of curvature is the radius of a circle drawn to encompass the curved surface. The curved surface can have a radius of curvature of less than 5 millimeters, or less than 3 millimeters. The curved surface can have a radius of curvature of 500 to 3000 microns, 1000 to 2800 microns, or 1500 to 2600 microns. The curved surface can be a cylindrical section or a spherical section.

The ink jet printing module can be prepared by forming a stiffened piezoelectric element, and positioning the piezoelectric element over an ink chamber to subject ink within the chamber to a jetting pressure upon applying a jetting voltage. The stiffened piezoelectric element can be prepared by grinding a curved surface into a thin layer of piezoelectric material or by injection molding a precursor into a mold having the curved surface features of the piezoelectric element. For example, a mixture can be prepared from a piezoelectric material powder and an organic binder. The mixture is injection molded to form a green sheet, which can be heated to remove the binder. The green sheet can be a thin film having a thickness of 10 to 50 microns, or 20 to 40 microns. The powder can be sintered, for example, to at least about 95% of theoretical density. Injection molding to form a piezoelectric article is described, for example, in U.S. Pat. No. 5,340,510, which is incorporated by reference in its entirety.

The curvature stiffens the piezoelectric element and improves jetting of ink when a low voltage is applied to the element. A comparable ink jet printing module having a flat piezoelectric element requires application of a higher voltage to jet an ink drop of comparable volume. A concave surface relative to the chamber can lead to higher positive pressure within the chamber than negative pressure during jetting, for example, a pressure during jetting that can be up to two times higher the pressure during chamber filling. Reducing the dimensions of the ink jet printing module can also lead to higher voltage requirements to achieve a given drop volume. Smaller jets can make the print head more compact. The stiffened element can also allow ink jet modules to be made smaller because the piezoelectric element has a rigidity in at least one dimension that is higher than a flat piezoelectric element. When the piezoelectric element is curved in the resting state, the deflection normal to the piezoelectric element can be amplified relative to a flat plate. Moreover, thinner ink chambers can allow smaller-dimensioned jets having improved performance to be made.

Figure 4:
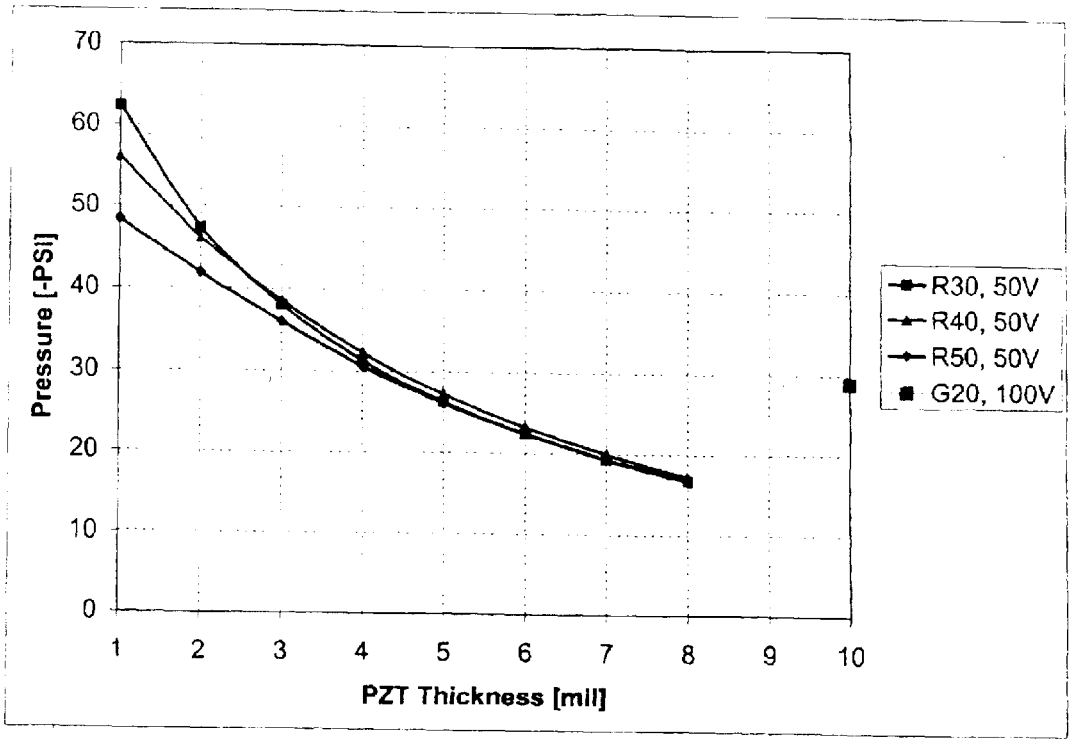
FIG. 4 is a graph depicting pressure generated in an ink chamber as the thickness of the piezoelectric element and curvature is varied.
Figure 5:
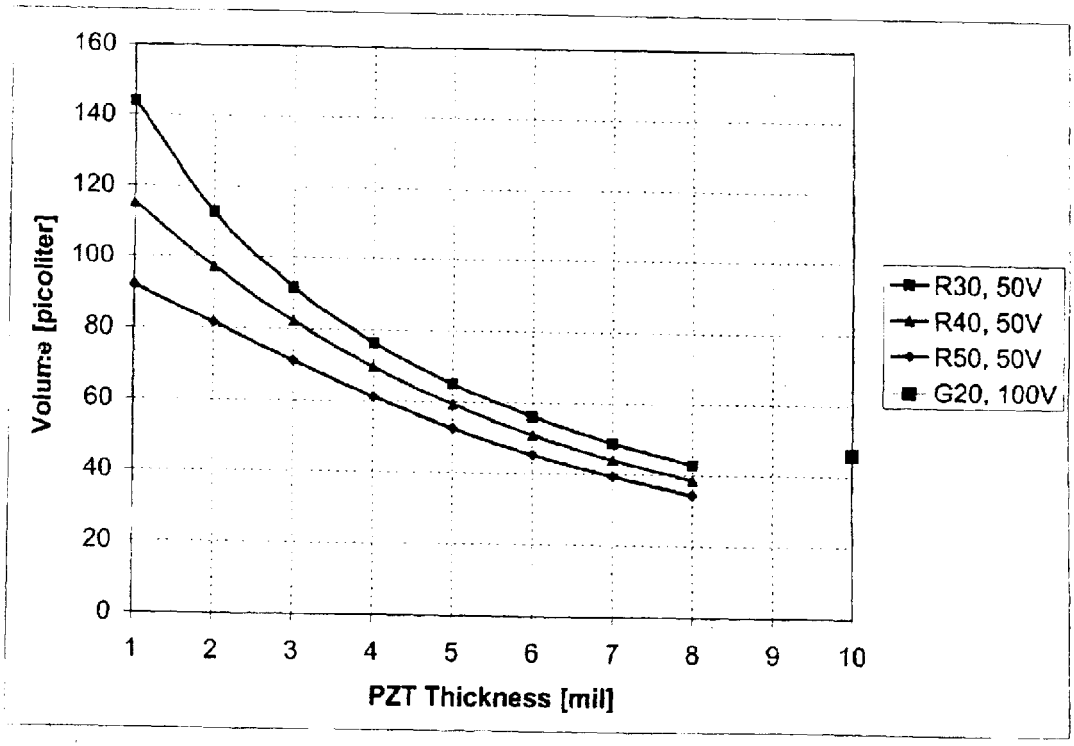
FIG. 5 is a graph depicting the change in volume generated in an ink chamber as the thickness of the piezoelectric element and curvature is varied.

Finite element analysis modeling of structures having a cylindrical shape (as shown in FIG. 3), a particular radius of curvature, and operated in an extension mode, demonstrated the improved pumping performance of the stiffened piezoelectric element relative to a flat element. In the model, ANSYS multiphysics coupled field analysis (ANSYS Version 5.7, ANSYS Inc. of Canonsburg, Pa.) was employed using the parameters of an ink chamber diameter of 0.102 cm, an ink chamber depth of 0.152 mm, lead zirconium titanate (PZT 5A, Morgan Electro Ceramics, Bedford, Ohio) poled in the thickness direction, a cavity plate constructed of KOVAR® (a low expansion iron-nickel-cobalt alloy available from High Temp Metals, Inc., Sylmar, Calif.), land piezoelectric width (the distance between chambers) of 0.254 mm, an ink density of 1000 kg/m$^3$, a pulse voltage of 50 volts, element thickness ranging from 1 mil (25.4 microns) to 10 mils (254 microns) and a radius of curvature of 30 mils, 40 mils, 50 mils, 100 mils or infinity (flat). The pressures and displacements generated by stiffened piezoelectric elements having particular thicknesses and radii of curvature are listed in Table 1. Pressures and total volume generated by stiffened piezoelectric elements are depicted in FIGS. 4 and 5. A comparative example of a flat piezoelectric element at a jetting voltage of 100 volts in shear mode is included as a comparison.

TABLE 1

| Example | PZT Thickness (mils) | Radius of curvature (mils) | Maximum Displacement (μm/μin) | Pressure (Pa/PSI) |
|---|---|---|---|---|
| 1 | 8 (203 microns) | 100 (2.54 mm) | 0.0229/0.901 | −73424/−10.6 |
| 2 | 5 (127 microns) | 100 (2.54 mm) | 0.0655/2.61 | −122827/−17.8 |
| 3 | 8 | 50 (1.27 mm) | 0.0347/1.36 | −96501/−13.9 |
| 4 | 5 | 50 (1.27 mm) | 0.0852/3.35 | −172939/−25.1 |

Figure 6:
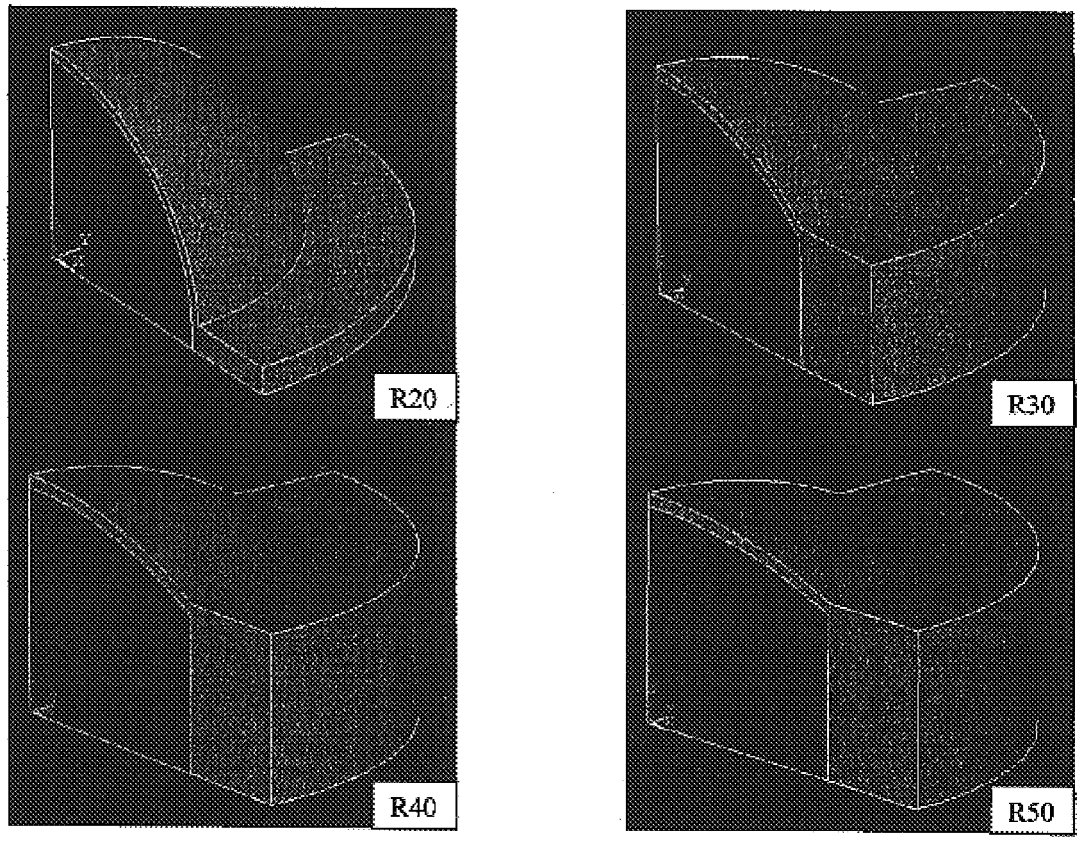
FIG. 6 is a schematic diagram depicting a piezoelectric element.
Figure 7:
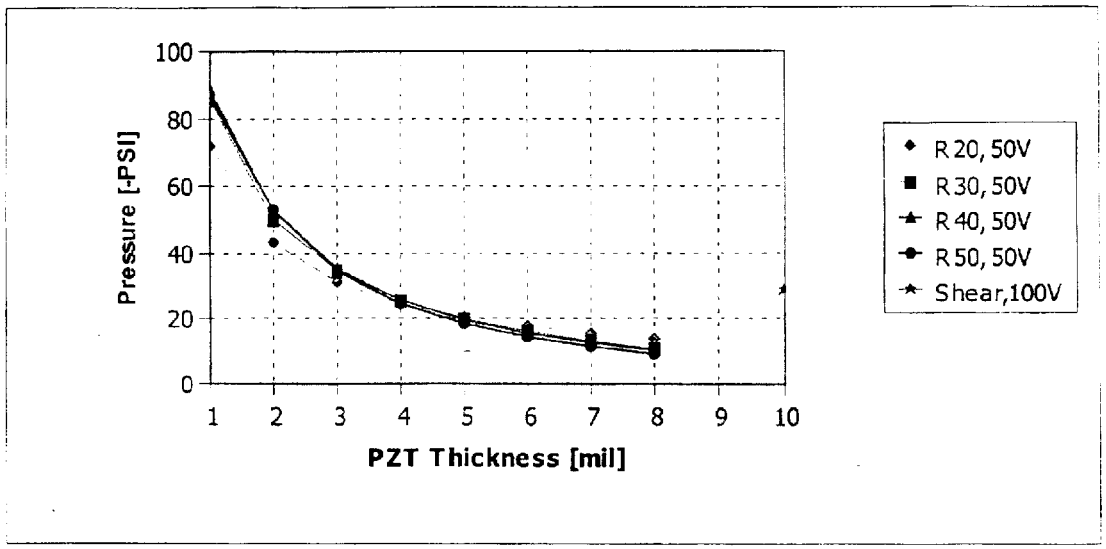
FIG. 7 is a graph depicting pressure generated in an ink chamber as the thickness of the piezoelectric element and curvature is varied.
Figure 8:
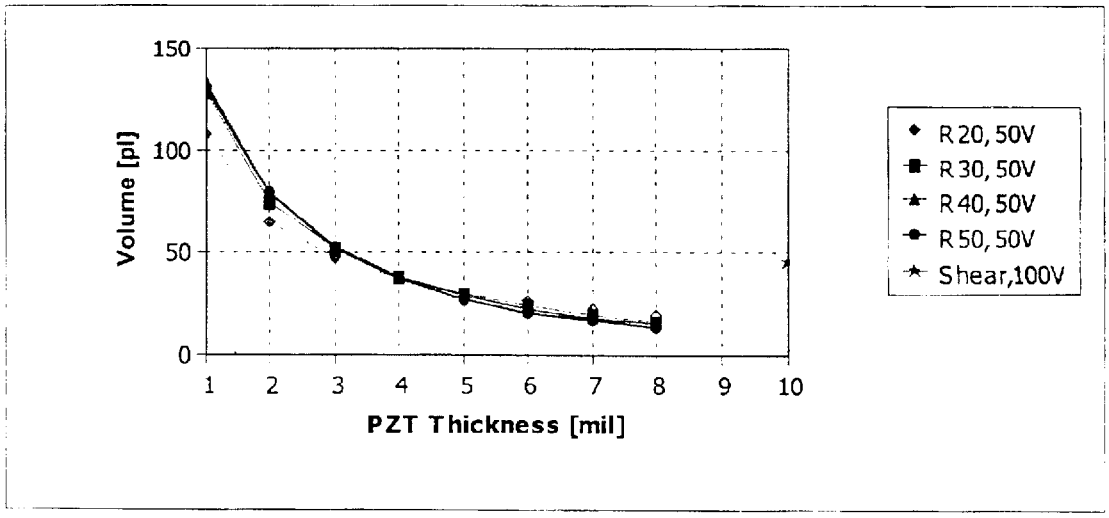
FIG. 8 is a graph depicting the drop volume generated by an ink chamber as the thickness of the piezoelectric element and curvature is varied.

Finite element analysis modeling of structures depicted in FIG. 6 having a spherical shape, a particular radius of curvature, operated in extension mode, and a constant total chamber volume also demonstrated the improved pumping performance of the stiffened piezoelectric element relative to a flat element. In this model, ANSYS multiphysics coupled field analysis was employed using the parameters of an ink chamber diameter of 0.102 cm, lead zirconium titanate (PZT 5A) poled in thickness direction, a cavity plate constructed of KOVAR®, land piezoelectric width (the distance between chambers) of 0.254 mm, an ink density of 1000 kg/m$^3$, a pulse voltage of 50 volts, piezoelectric element thickness ranging from 1 mil (25.4 microns) to 10 mils (254 microns) and a radius of curvature of 20 mils, 30 mils, 40 mils, 50 mils or infinity (flat). The volume of pumping chamber was kept at $3.14\times10^{-10}$ m$^3$, which is same as the total volume in the comparative case. Since the chamber diameter is also a constant (0.102 cm) and the radius of curvature varies, the chamber depth becomes a variable. The chamber depth for each radius of curvature was: R=20 mil, depth=2 mil; R=30 mil, depth=11.33 mil; R=40 mil, depth=12.59 mil; or R=50 mil, depth=13.22 mil. The pressures and drop volumes generated by stiffened piezoelectric elements having particular thicknesses and radii of curvature are listed in Table 2. Chamber pressures and drop volumes generated by stiffened piezoelectric elements are depicted in FIGS. 7 and 8. A comparative example of a flat piezoelectric element at a jetting voltage of 100 volts in shear mode is included as a comparison.

TABLE 2

| Example | PZT Thickness (mils) | Radius of curvature (mils) | Drop Volume (pL) | Chamber Pressure (PSI) |
|---|---|---|---|---|
| 5 | 1 | 50 | 131.228 | 87.214 |
| 6 | 1 | 40 | 133.948 | 89.039 |

TABLE 2-continued

| Example | PZT Thickness (mils) | Radius of curvature (mils) | Drop Volume (pL) | Chamber Pressure (PSI) |
|---|---|---|---|---|
| 7 | 1 | 30 | 129.770 | 86.219 |
| 8 | 1 | 20 | 108.323 | 71.975 |
| 9 | 2 | 50 | 79.418 | 52.793 |
| 10 | 2 | 40 | 79.210 | 52.621 |
| 11 | 2 | 30 | 74.931 | 49.938 |
| 12 | 2 | 20 | 65.243 | 43.350 |
| 13 | 3 | 50 | 52.607 | 35.003 |
| 14 | 3 | 40 | 53.339 | 35.462 |
| 15 | 3 | 30 | 52.048 | 34.591 |
| 16 | 3 | 20 | 47.289 | 31.421 |
| 17 | 4 | 50 | 37.363 | 24.844 |
| 18 | 4 | 40 | 38.614 | 25.704 |
| 19 | 4 | 30 | 38.713 | 25.760 |
| 20 | 4 | 20 | 37.351 | 24.817 |
| 21 | 5 | 50 | 27.841 | 18.509 |
| 22 | 5 | 40 | 29.173 | 19.464 |
| 23 | 5 | 30 | 30.405 | 20.245 |
| 24 | 5 | 20 | 30.862 | 20.534 |
| 25 | 6 | 50 | 21.410 | 14.270 |
| 26 | 6 | 40 | 22.986 | 15.312 |
| 27 | 6 | 30 | 24.595 | 16.370 |
| 28 | 6 | 20 | 26.384 | 17.548 |
| 29 | 7 | 50 | 17.299 | 11.529 |
| 30 | 7 | 40 | 18.723 | 12.486 |
| 31 | 7 | 30 | 20.271 | 13.555 |
| 32 | 7 | 20 | 23.093 | 15.371 |
| 33 | 8 | 50 | 14.300 | 9.555 |
| 34 | 8 | 40 | 15.564 | 10.393 |
| 35 | 8 | 30 | 16.819 | 11.274 |
| 36 | 8 | 20 | 20.519 | 13.680 |
| Comparative 37[a] | 10 | Flat | 46.221 | 29.008 |

[a]100 V driving voltage

Figure 9:
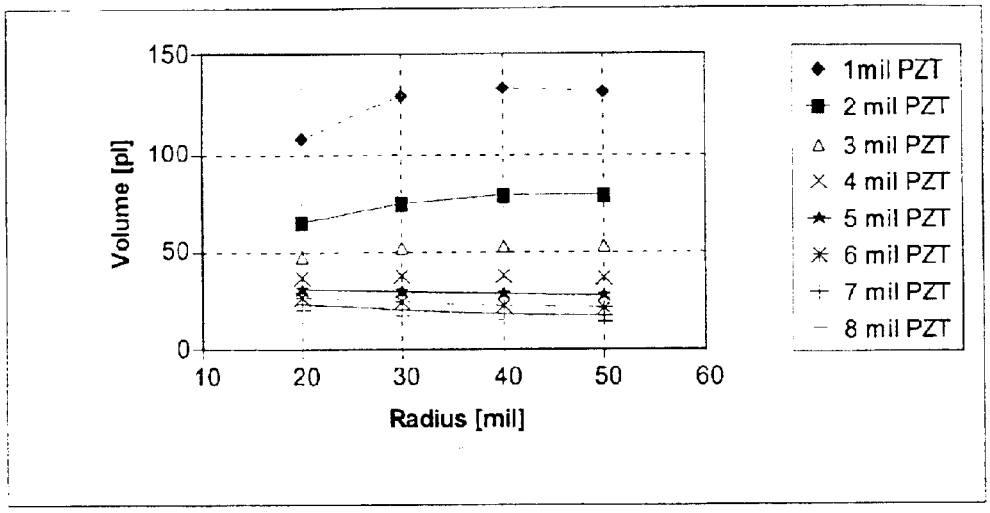
FIG. 9 is a graph depicting the drop volume generated by an ink chamber as the thickness of the piezoelectric element and curvature is varied.

Additional finite element analysis modeling of structures depicted in FIG. 6 having a spherical shape, a particular radius of curvature, operated in extension mode, and a constant total volume demonstrated the improved pumping performance of the stiffened piezoelectric element relative to a flat element. In this model, ANSYS multiphysics coupled field analysis was employed using the parameters of an ink chamber diameter of 0.102 cm, an ink chamber depth of 0.152 mm, lead zirconium titanate (PZT 5A) poled in thickness direction, a cavity plate constructed of KOVAR®, land piezoelectric width (the distance between chambers) of 0.254 mm, an ink density of 1000 kg/m$^3$, a pulse voltage of 50 volts, piezoelectric element thickness ranging from 1 mil (25.4 microns) to 8 mils (203 microns) and a radius of curvature of 20 mils, 30 mils, 40 mils, or 50 mils. Since the chamber diameter is also a constant (0.102 cm) and the radius of curvature varies, the chamber depth becomes a variable. The chamber depth for each radius of curvature was: R=20 mil, depth=2 mil; R=30 mil, depth=11.33 mil; R=40 mil, depth=12.59 mil; or R=50 mil, depth=13.22 mil. The drop volumes generated by stiffened piezoelectric elements having particular thicknesses and radii of curvature are depicted in FIG. 9.

Figure 10:
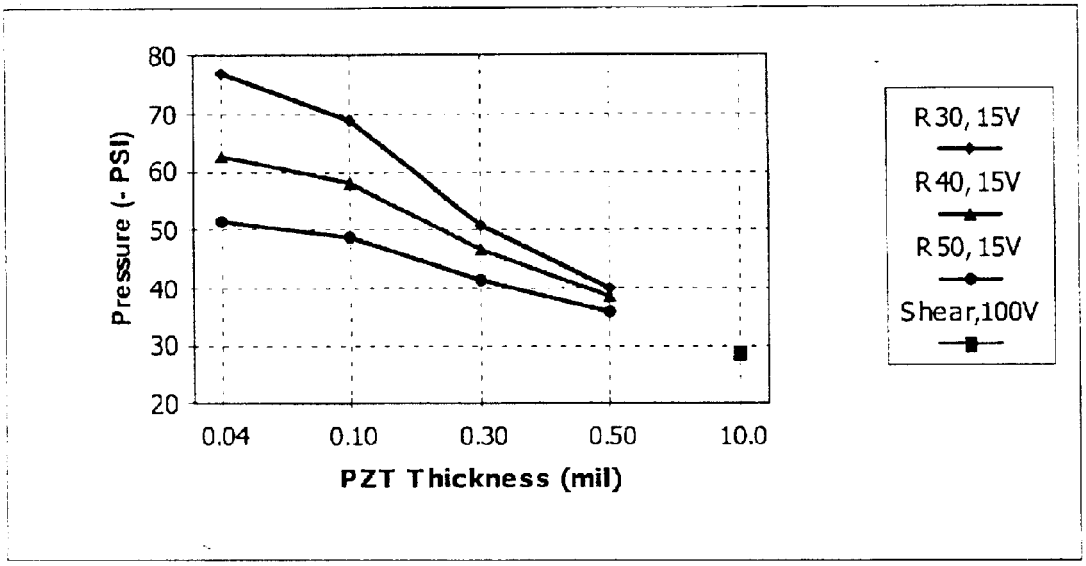
FIG. 10 is a graph depicting pressure generated in an ink chamber as the thickness of the piezoelectric element and curvature is varied.
Figure 11:
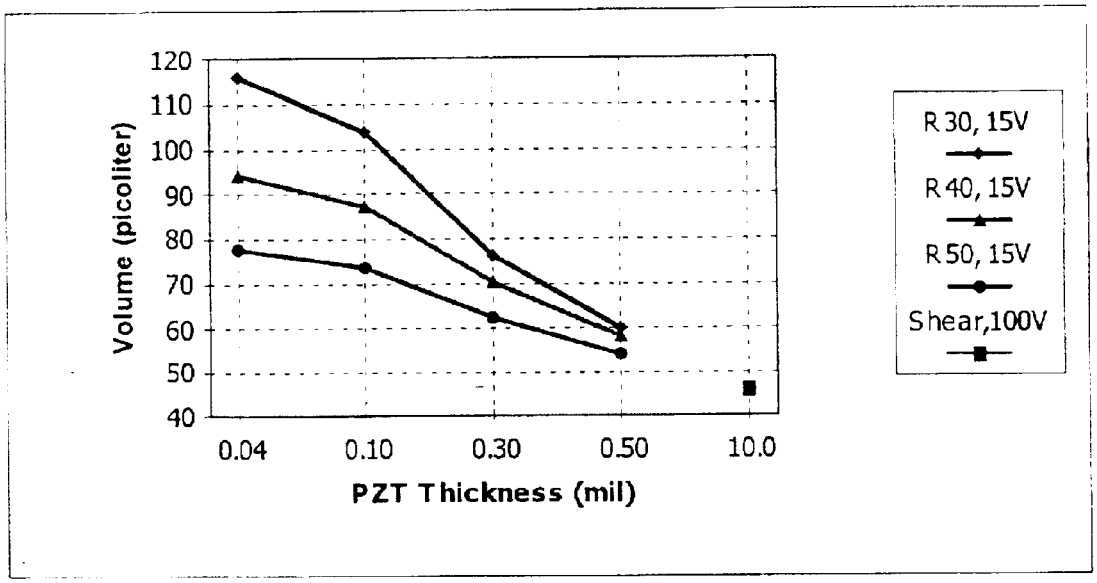
FIG. 11 is a graph depicting the drop volume generated by an ink chamber as the thickness of the piezoelectric element and curvature is varied.

Other finite element analysis modeling of structures depicted in FIG. 6 having a spherical shape, a particular radius of curvature, operated in extension mode, and a constant total chamber volume also demonstrated the improved pumping performance of the stiffened piezoelectric element relative to a flat element. In this model, ANSYS multiphysics coupled field analysis was employed using the parameters of an ink chamber diameter of 0.102 cm, an ink chamber depth of 0.152 mm, lead zirconium titanate (PZT 5A) poled in thickness direction, a cavity plate constructed of KOVAR®, land piezoelectric width (the distance between chambers) of 0.254 mm, an ink density of 1000 kg/m$^3$, a pulse voltage of 15 volts, piezoelectric element thickness of 0.04 mil (1 micron), 0.10 mil (2.5 microns), 0.30 mil (7.5 microns), 0.50 mil (12.5 microns) or 10 mils (254 microns) and a radius of curvature of 30 mils, 40 mils, 50 mils or infinity (flat). Since the chamber diameter is also a constant (0.102 cm) and the radius of curvature varies, the chamber depth becomes a variable. The chamber depth for each radius of curvature was: R=30 mil, depth=11.33 mil; R=40 mil, depth=12.59 mil; or R=50 mil, depth=13.22 mil. The pressures and drop volumes generated by stiffened piezoelectric elements having particular thicknesses and radii of curvature are listed in Table 3. Chamber pressures and drop volumes generated by stiffened piezoelectric elements are depicted in FIGS. 10 and 11. A comparative example of a flat piezoelectric element at a jetting voltage of 100 volts in shear mode is included as a comparison.

TABLE 3

| Example | PZT Thickness (mils) | Radius of curvature (mils) | Drop Volume (pL) | Chamber Pressure (PSI) |
|---|---|---|---|---|
| 38 | 0.04 | 30 | 77.121 | 116.199 |
| 39 | 0.04 | 40 | 62.607 | 94.260 |
| 40 | 0.04 | 50 | 51.683 | 77.890 |
| 41 | 0.10 | 30 | 69.069 | 104.067 |
| 42 | 0.10 | 40 | 58.078 | 87.422 |
| 43 | 0.10 | 50 | 48.929 | 73.738 |
| 44 | 0.30 | 30 | 50.714 | 76.390 |
| 45 | 0.30 | 40 | 46.576 | 70.108 |
| 46 | 0.30 | 50 | 41.443 | 62.445 |
| 47 | 0.50 | 30 | 39.929 | 60.113 |
| 48 | 0.50 | 40 | 38.690 | 58.226 |
| 49 | 0.50 | 50 | 35.797 | 53.901 |
| Comparative 50[a] | | | 29.008 | 46.221 |

[a]100 V driving voltage

A number of embodiments have been described. Other embodiments are within the scope of the following claims.

What is claimed is:

1. A method of depositing ink comprising:

delivering ink to an ink chamber; and applying a jetting voltage across a first electrode and a second electrode on a face of a stiffened piezoelectric element to subject ink within the chamber to a jetting pressure, thereby depositing ink from an exit orifice of the ink chamber, wherein the stiffened piezoelectric element has a region spanning the ink chamber and being substantially completely exposed to the ink chamber, the exposed region having a curved surface over the ink chamber, the curved surface having a substantially constant radius of curvature and being concave relative to the ink chamber.

2. The method of claim 1, wherein the piezoelectric element includes lead zirconium titanate.

3. The method of claim 1, wherein the jetting voltage is less than 60 volts.

4. The method of claim 1, wherein the substantially constant radius of curvature is less than 5 millimeters.

5. The method of claim 1, wherein the piezoelectric element a thickness of 5 to 300 microns.

6. The method of claim 1, wherein the piezoelectric element a thickness of 10 to 250 microns.

7. The method of claim 1, wherein the piezoelectric element has a thickness of less than 100 microns.

8. The method of claim 1, wherein the chamber has a width of less than 1200 microns.

9. The method of claim 1, wherein the chamber has a width of 50 to 1000 microns.

10. The method of claim 1, wherein the chamber has a width of 100 to 800 microns.

11. The method of claim 1, wherein the curved surface has a radius of curvature of 500 to 3000 microns.

12. The method of claim 1, wherein the curved surface has a radius of curvature of 1000 to 2800 microns.

13. The method of claim 1, wherein the curved surface has a radius of curvature of 1500 to 2600 microns.

14. The method of claim 1, wherein the electrodes are configured to apply a voltage of less than 60 volts.

15. The method of claim 1, further comprising a series of chambers.

16. The method of claim 1, wherein each of the chambers is covered by a single piezoelectric element.

17. The method of claim 1, wherein the chamber includes a wall contacting the piezoelectric element exposed to the ink chamber at an angle of greater than ninety degrees.

* * * * *